US006842118B2

(12) United States Patent
Igarashi et al.

(10) Patent No.: US 6,842,118 B2
(45) Date of Patent: Jan. 11, 2005

(54) OVERLOAD DETECTOR OF VEHICLE FOR HIGH LIFT WORK

(75) Inventors: Teruo Igarashi, Ibaraki (JP); Atsushi Tadokoro, Ibaraki (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 102 days.

(21) Appl. No.: 10/380,310

(22) PCT Filed: Apr. 25, 2002

(86) PCT No.: PCT/JP02/04142

§ 371 (c)(1),
(2), (4) Date: Mar. 13, 2003

(87) PCT Pub. No.: WO03/010082

PCT Pub. Date: Feb. 6, 2003

(65) Prior Publication Data

US 2003/0174064 A1 Sep. 18, 2003

(30) Foreign Application Priority Data

Jul. 23, 2001 (JP) ..... 2001-221634

(51) Int. Cl.[7] ..... G08B 21/00

(52) U.S. Cl. ..... 340/665; 340/438; 340/440; 340/685; 340/691.2; 340/691.4

(58) Field of Search ..... 340/665, 438, 340/440, 685, 691.2, 691.4

(56) References Cited

U.S. PATENT DOCUMENTS 6,585,079 B1 * 7/2003 Weyer ..... 182/2.7

FOREIGN PATENT DOCUMENTS

| | | | | |
|---|---|---|---|---|
| JP | 60-232384 | | 11/1985 | |
| JP | 6-18397 | | 3/1994 | |
| JP | 6-28555 | | 8/1994 | |
| JP | 8-217276 | | 8/1996 | |
| JP | 2531316 | | 1/1997 | |
| JP | 9-86899 | | 3/1997 | |
| JP | 410194698 A | * | 7/1998 | ..... B66F/9/24 |
| JP | 2000-256000 | | 9/2000 | |
| JP | 2002-104798 | * | 4/2002 | ..... B66F/9/24 |

* cited by examiner

*Primary Examiner*—Daniel J. Wu
*Assistant Examiner*—Tai T. Nguyen
(74) *Attorney, Agent, or Firm*—Mattingly, Stanger & Malur, P.C.

(57) ABSTRACT

An overload detection device for a high-lift work vehicle is capable of detecting the load on the work platform. A base 10 of the work platform is supported with a bracket 9 at, at least, three supporting portions. Load sensors 11 each constituted of a plate member 14 and distortion gauges 15~18 detect the extent of flexure of at least two of the supporting portions.

11 Claims, 8 Drawing Sheets

OVERLOAD DETECTOR OF VEHICLE FOR HIGH LIFT WORK

TECHNICAL FIELD

The present invention relates to an overload detection device that detects whether or not the load on the work platform of a high-lift work vehicle is excessive.

BACKGROUND ART

An overload detection device is installed in a high-lift work vehicle to prevent it from overturning due to a load placed on its work platform that is excessively large relative to the work radius. Japanese Registered Utility Model Gazette No. 2531316 discloses a structure through which the load on the work platform at the front end of the boom is detected by providing a plurality of load cells between the floor frame and the floorboard and adding the values indicated by the detection signals from the load cells.

In addition, Japanese Unexamined Patent Publication No. 1994-18397 discloses a structure achieved by linking the inner section of the telescopic boom and the work platform via a load sensor and also providing a load center between the level cylinder and the work platform to determine the load on the work platform based upon the signals output from the load sensors.

DISCLOSURE OF THE INVENTION

If a structure that includes load cells provided between the floor frame and the floor board as disclosed in Japanese Registered Utility Model Gazette No. 2531316 is adopted, which is bound to be costly since load cells are normally expensive, an accurate load detection cannot be achieved if either the floor frame or the floor board or both are twisted to cause a failure in some of the load cells to detect the load.

The device disclosed in the Japanese Unexamined Utility Model Publication No. 1994-18397, which requires special load sensors and a complex arithmetic operation to be executed, will tend to be costly.

An object of the present invention is to provide an inexpensive overload detection device for a high-lift work vehicle capable of accurately detecting the load on the work platform.

(1) In order to achieve the object described above, the present invention provides an overload detection device for a high-lift work vehicle having a work platform mounted at the front end of a telescopic boom via a bracket, which is achieved by supporting a base of the work platform with the bracket at, at least, three supporting portions and mounting load sensors each constituted of a plate member and a distortion gauge mounted at the plate member to detect the extent to which the plate member becomes flexed at, at least, two supporting portions among the supporting portions, with the two ends of the plate member of each load sensor joined to the bracket and the base with bolts and an elastic member provided at a connecting area where the plate member is connected with either the bracket or the base so as to allow vertical displacement of the load sensor relative to the bracket or the base.

A load sensor achieved by mounting at a plate member a distortion gauge which registers a different resistance value in conformance to the extent of the flexure of the plate member as described above is not as expensive as a standard load cell. In addition, by supporting the base with the bracket at, at least, three supporting portions so as to form a polygons with the supporting points, the base can be supported relative to the bracket in a stable manner. In addition, the load sensors provided at two of the supporting portions each have one end thereof connected to the bracket and the other end thereof connected to the base, and either the bracket-side connecting portion or the base-side connecting portion of the load sensor is connected to the bracket or the base via an elastic member so as to allow displacement along both the upward direction and the downward direction. As a result, even when the bracket or the base is twisted, the individual load sensors are allowed to perform a uniform load detection operation to enable an accurate load detection.

(2) According to the present invention, it is desirable to constitute the load sensors each by pasting distortion gauges capable of detecting positive and negative loads at the front and rear surfaces of the plate member.

With the distortion gauges pasted onto the front and rear surface of the plate member as described above, the extent of flexure of the plate member can be detected along the positive direction and the negative direction and by determining the difference between the positive flexure and the negative flexure, a large detection signal can be obtained even when the extent of flexure is very small. In addition, since both the positive and negative loads are detected, an accurate load detection is enabled by adding the values indicated by the detection signals from all the load sensors even when a load is applied to a position outside the range enclosed by the plurality of load sensors as may be the case if the operator or the like places himself at an off-centered position on the work platform.

(3) According to the present invention, it is also desirable that the load sensors each be constituted by pasting two distortion gauges onto each of the front and rear surfaces of the plate member so that there are two pairs of distortion gauges with the distortion gauges in each pair facing opposite each other at the front and rear surfaces. The four distortion gauges which are built into a wheatstone bridge assume a circuit structure in which a load detection signal is obtained by adding the distortion detection quantity detected by one of the pairs of distortion gauges facing opposite each other at the front and rear surfaces and the distortion detection quantity detected by to the other pair of distortion gauges. According to the present invention, it is also desirable that the output lines of the individual wheatstone bridges be connected in parallel to one another to input the signals from the wheatstone bridges to an amplifier circuit so as to obtain the average of the distortion detection quantities output from the wheatstone bridges by averaging them.

By utilizing such load sensors adopting the load detection circuit structure described above, an even larger load detection signal is obtained to further improve the detection accuracy.

(4) Moreover, according to the present invention, it is desirable that the bracket and the base be supported at four supporting portions corresponding to the four corners of a square or a rectangle having two sides thereof extending to the front and the rear with the load sensors provided at, at least, two of the supporting portions.

By setting the supporting portions so that the lines connecting the supporting portions form a square or a rectangle and providing load sensors at, at least, two of the supporting portions, a highly accurate load detection is enabled.

(5) The overload detection device according to the present invention should preferably include a means for comparison that compares a load detection value obtained based upon the detection signals from the load sensors with a predetermined overload value and a means for warning generation that issues a warning if an overload is detected by the means for comparison.

By providing a means for warning generation that issues a warning when an overload is detected, it becomes possible to alert the operator that the work vehicle is in a state of overload. Thus, the operator is able to take measures to correct the overload state so as to avert an accident induced by the overload.

Alternatively, it is desirable that the overload detection device according to the present invention include a means for comparison that compares a load detection value obtained based upon the detection signals from the load sensors with a predetermined overload value and a means for control that disallows an operation of the work vehicle that would increase the work radius if an overload is detected by the means for comparison.

By automatically disallowing an operation of the work vehicle that would increase the work radius if an overload state is detected, it becomes possible to avert an accident induced by the overload without requiring any operator operation.

BEST MODE FOR CARRYING OUT THE INVENTION

Figure 1A:
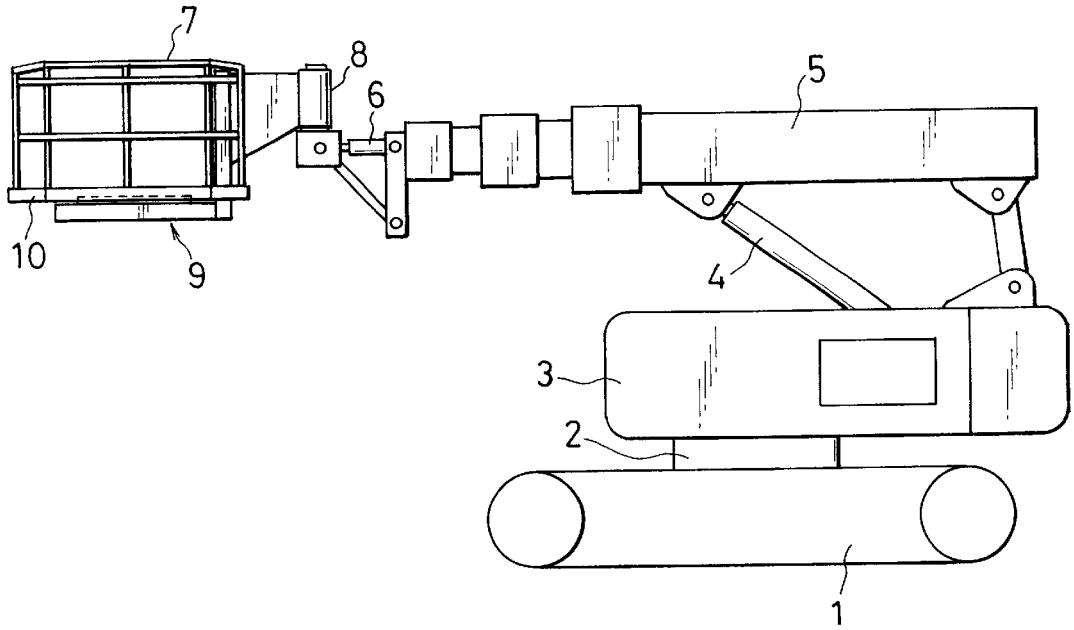
FIG. 1A is a side elevation of a high-lift work vehicle, illustrating an embodiment of the overload detection device for a high-lift work vehicle according to the present invention.
Figure 1B:
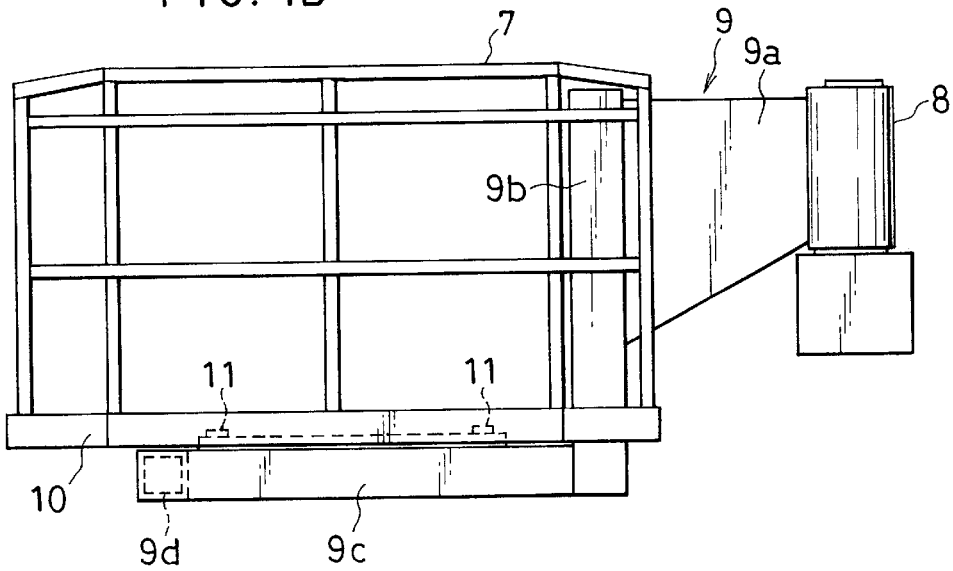
FIG. 1B is an enlarged side elevation of the work platform of the high-lift work vehicle.

FIG. 1A is a side elevation of a high-lift work vehicle, illustrating the overload detection device for a high lift work vehicle achieved in an embodiment of the present invention and FIG. 1B is an enlarged side elevation of the work platform of the high-lift work vehicle. As shown in FIG. 1A, the high lift work vehicle includes a revolving superstructure 3 mounted with a power unit set on a traveling superstructure 1 via a swing device 2, a telescopic boom 5 mounted at the revolving superstructure 3 in such a manner that the telescopic boom 5 can be freely hoisted up and down by a derrick cylinder 4 and a work platform bracket 9 which is mounted at the front end of the telescopic boom 5 via a levelling cylinder 6 for holding a work platform 7 level and a swing device 8 that swings the work platform 7.

Figure 2A:
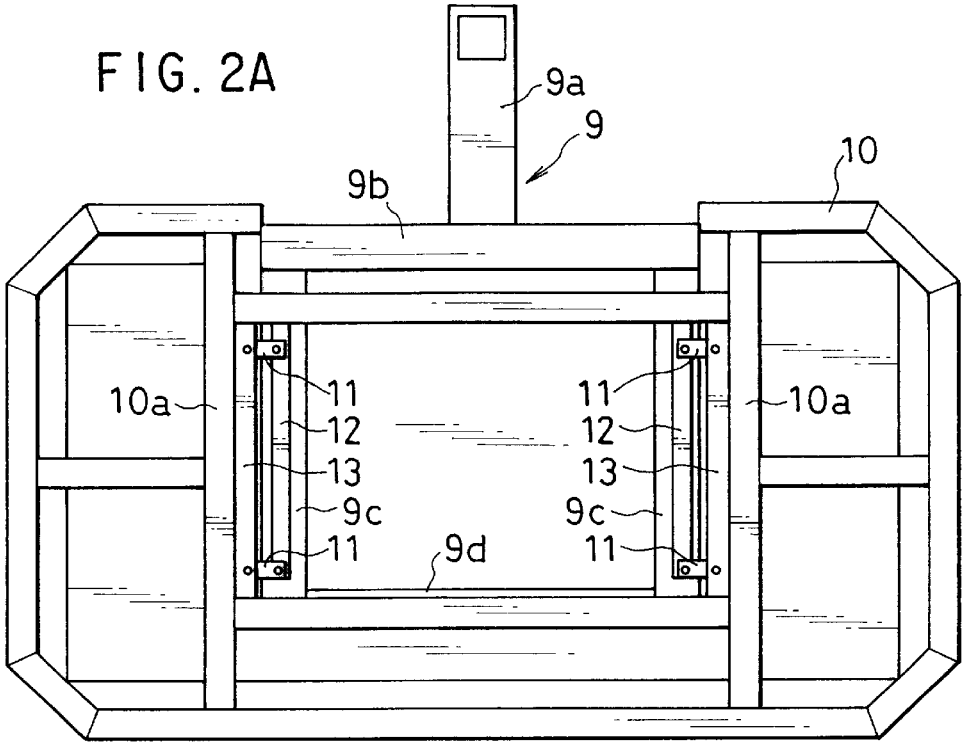
FIGS. 2A and 2B are a plan view and a front view respectively of the work platform achieved in the embodiment.
Figure 2B:
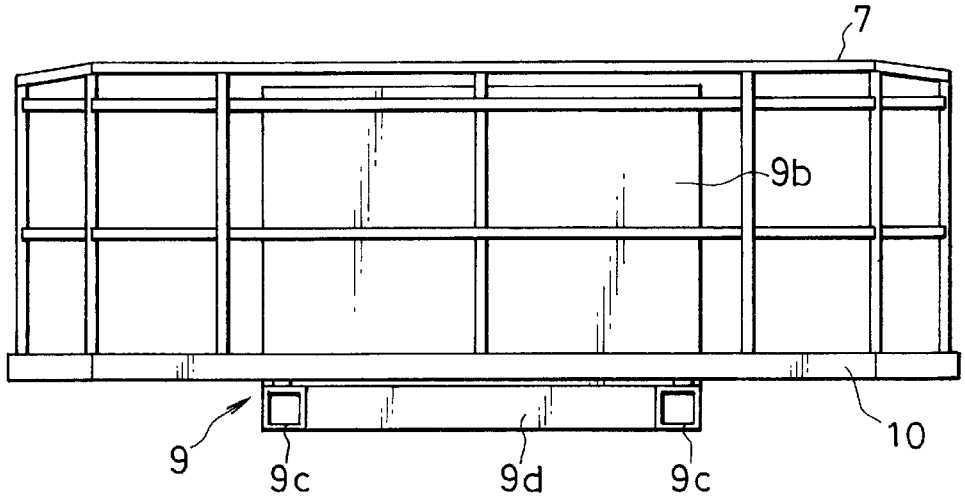

As shown in FIG. 1B, in the plan view in FIG. 2A and in the front view in FIG. 2B, the bracket 9 is constituted of a mounting frame 9A which is linked to the swinging side of the swing device 8, a rear frame 9*b* secured to the front portion of the mounting frame 9A, left and right side frames 9*c* and 9*c* secured to the bottom of the rear frame 9*b* and extending from the left and right sides of the bottom of the rear frame 9*b* toward the front and a front frame 9*d* having the two ends thereof secured to the front portions of the side frames 9*c* and 9*c*.

Reference numeral 10 indicates a base of the work platform 7. Reference numeral 11 indicates a load sensor, which is mounted between the upper surface of a side frame 9*c* of the bracket 9 and an inner frame 10*a* of the base 10. The load sensors 11 are provided at four supporting portions, with the lines connecting the supporting portions forming a quadrangle (either a square or a rectangle with its two sides extending along the front/rear direction).

Figure 3A:
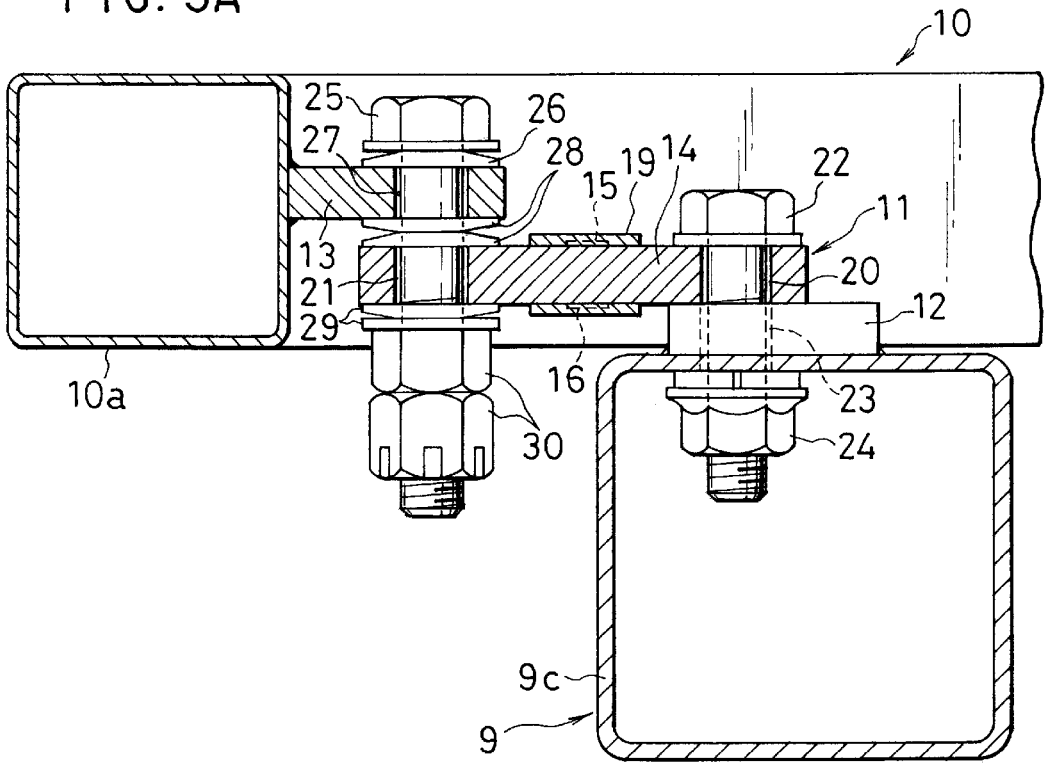
FIG. 3A is a sectional view showing the load sensor mounting structure adopted in the embodiment.
Figure 3B:
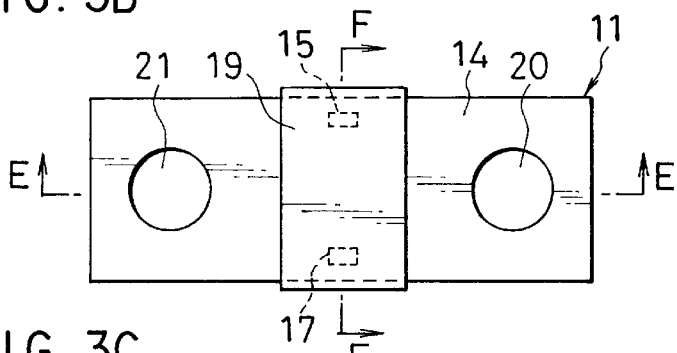
FIG. 3B is a plan view of a load sensor and FIGS. 3C and 3D are sectional views taken along E—E and F—F respectively in FIG. 3B.
Figure 3C:
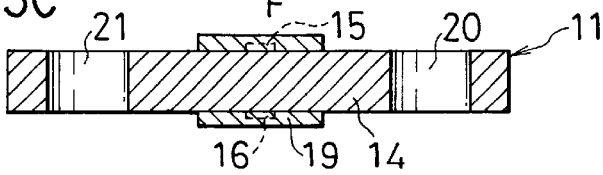
Figure 3D:
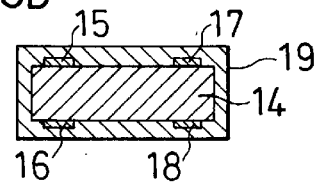

FIG. 3A is a longitudinal sectional view showing a structure through which the load sensors 11 are each mounted, FIG. 3B is a plan view of a load sensor and FIGS. 3C and 3D are sectional views respectively taken along E—E and F—F in FIG. 3B. In FIG. 3A, reference numeral 12 indicates a mount at which the load sensor 11 is mounted, welded to the upper surface of the side frame 9*c* of the bracket 9 and reference numeral 13 indicates a mounting edge welded to the inner surface of the inner frame 10*a* of the bracket 10 at which the load sensor 11 is mounted. As shown in FIGS. 3B~3D, each load sensor 11 is constituted by pasting distortion gauges 15~18, two each onto the front surface and the rear surface of a plate member 14 formed from a steel product so that the two pairs of distortion gauges are provided at the front and rear surfaces with the distortion gauges in each pair facing opposite each other and then molding the areas where the distortion gauges 15~18 have been pasted with a resin 19. Reference numerals 20 and 21 indicate bolt insertion holes provided near the two ends of the plate member 14.

As shown in FIG. 3A, a bolt 22 is inserted at the bolt insertion hole 20 at one end of the load sensor 11 and also at a bolt insertion hole 23 formed at the mount 12 and in the top plate of the side frame 9*c*, and the bolt 22 is then interlocked with a nut 24 and is tightened to link the one end of the load sensor 11 with the side frame 9*c* of the base 9, whereas at the other end of the load sensor 11, a bolt 25 is inserted through a disk spring 26, a bolt insertion hole 27 at the edge 13, a disk spring 28, the bolt insertion hole 21 of the load sensor 11 and a disk spring 29 and then the bolt 25 is interlocked with a nut 30 and is tightened to link the other end of the load sensor 11 with the inner frame 10*a* of the bracket*[1] 10. Through the steps described above, the load sensor 11 is mounted.

Figure 4A:
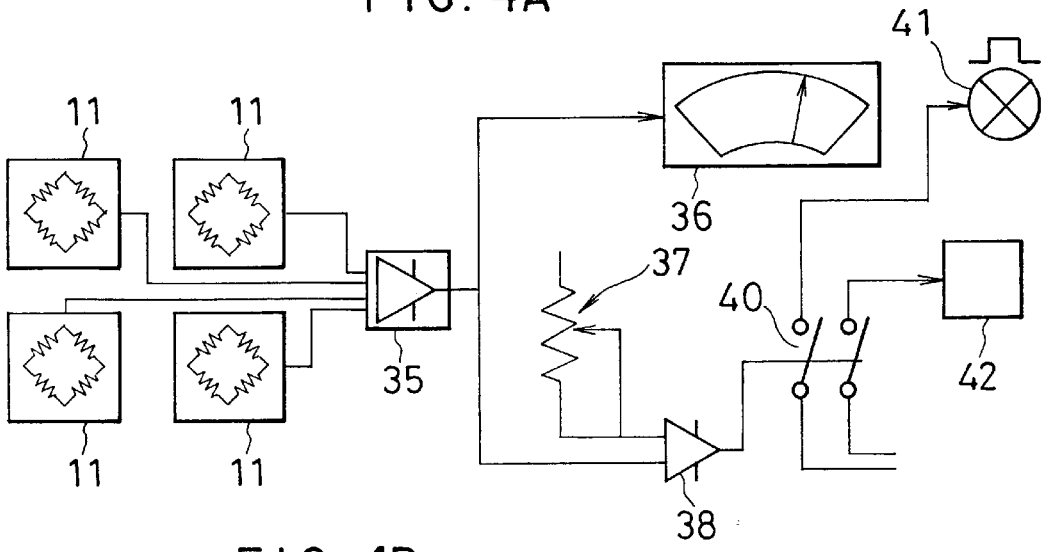
FIG. 4A is a circuit diagram of the overload detection device achieved in an embodiment of the present invention and FIGS. 4B~4D present circuit diagrams of examples of structures that may be adopted in the wheatstone bridges according to the present invention.
Figure 4B:
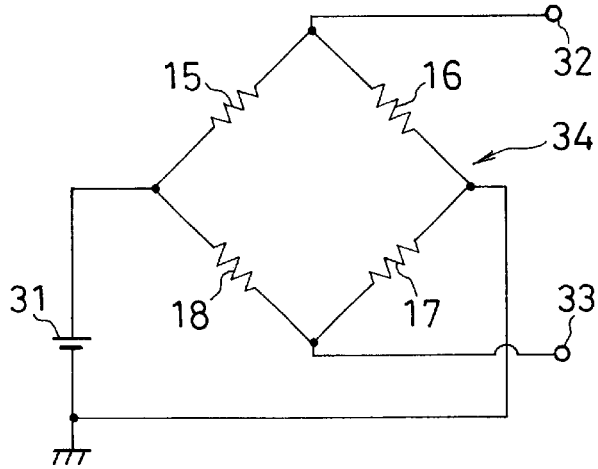

FIG. 4A presents an example of a circuit structure that may be adopted in the overload detection device employing the load sensors 11 described above. As shown in FIG. 4B, each load sensor 11 assumes a structure achieved by connecting a wheatstone bridge 34 constituted of the distortion gauges 15~18 to a DC source 31 so as to set the distortion gauges 15 and 17 on the front surface of the plate member 14 on the opposite sides of a bridge arm and leading out the connecting point of the distortion gauges 15 and 16 at the front and rear surfaces constituting one pair and the connecting point of the distortion gauges 17 and 18 at the front and rear surfaces constituting the other pair to output ends 32 and 33 respectively.

Figure 5:
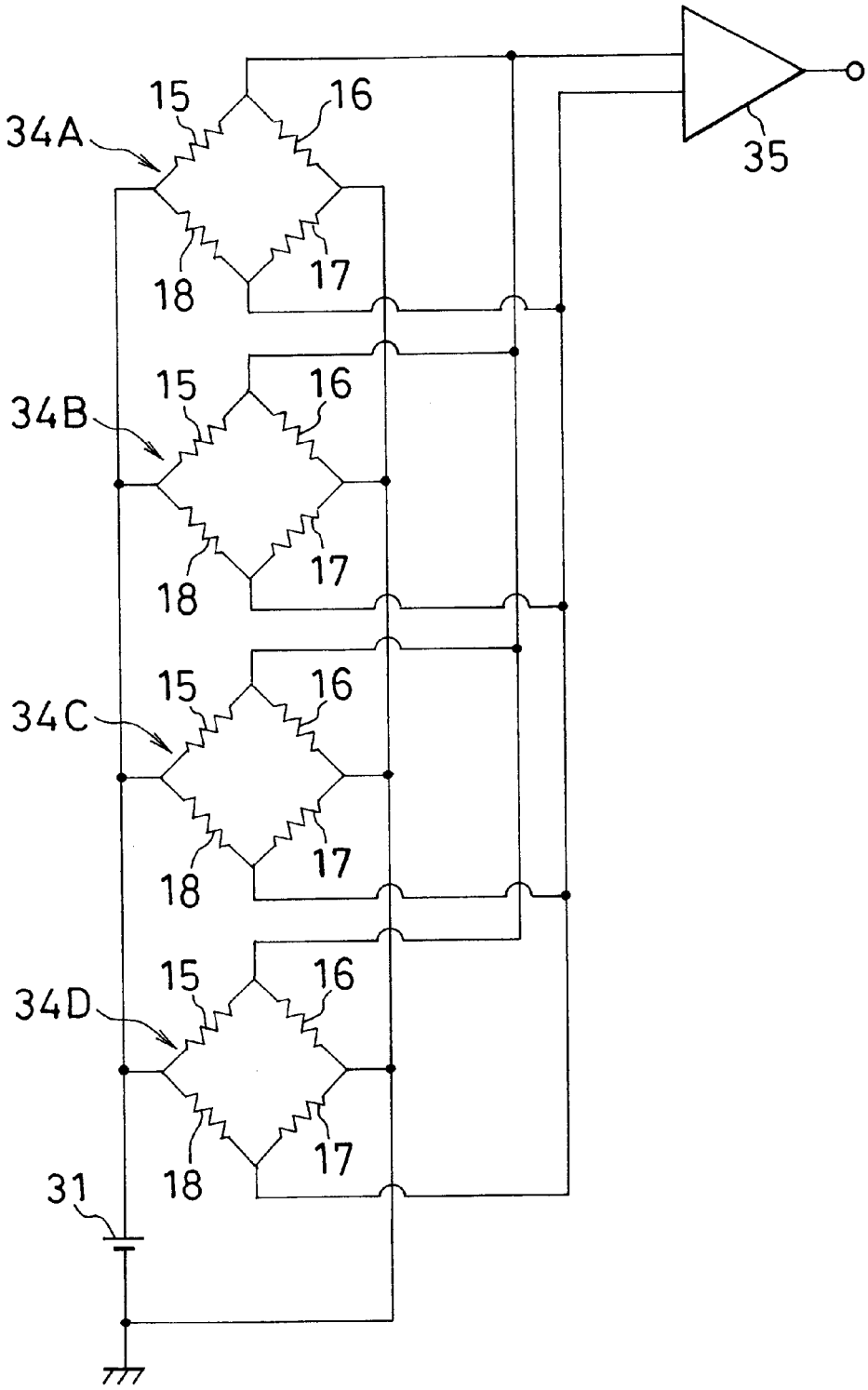
FIG. 5 is a circuit diagram of an example of a circuit in which the outputs from the wheatstone bridges are averaged according to the present invention.

The output ends 32 and 33 of the individual wheatstone bridges 34 are input to an amplifier circuit 35 as shown in FIG. 4A where their sum is obtained (or their average is obtained). FIG. 5 presents an example of how the outputs from the wheatstone bridges may be input to the amplifier circuit 35. In the example presented in FIG. 5, the output lines of the four wheatstone bridges 34A~34D are connected in parallel and are input to the amplifier circuit 35 to enable the amplifier circuit 35 to obtain the arithmetic average of the distortion quantities output from the individual load sensors 11.

As shown in FIG. 4A, the detected load indicated by the signal output from the amplifier circuit 35 is indicated on an indicator 36 such as meter to be visually checked by the operator. In addition, a comparator 38 compares the detected load with a predetermined overload value set through an overload setting instrument 37, and if the detected load exceeds the preset value, a relay contact point 40 is switched to activate a means for warning generation such as a warning buzzer 41 or a voice warning generator 42.

Figure 6A:
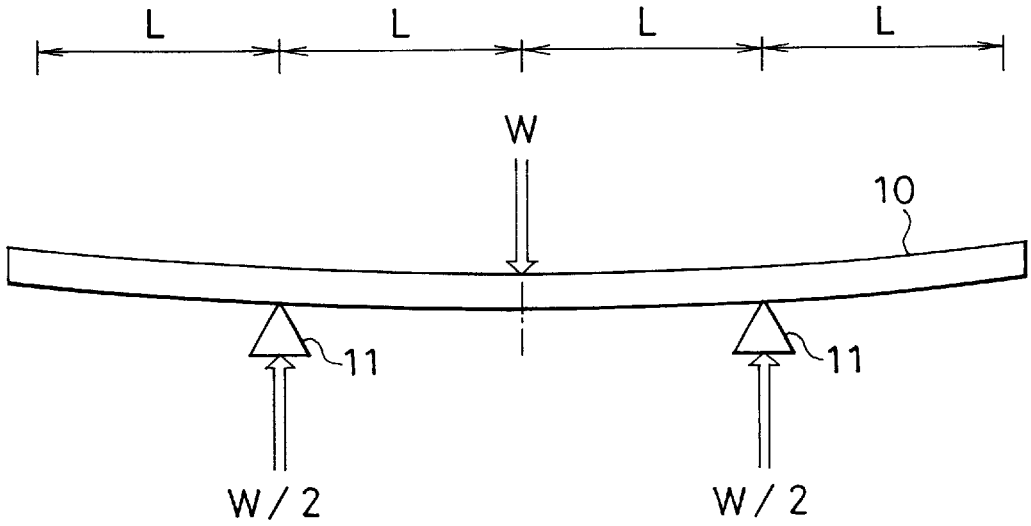
FIGS. 6A and 6B illustrate the load detection operations performed by the load sensors in different load modes according to the present invention.

FIG. 6 shows the relationship between the load on the base 10 and the detection outputs provided by the load sensors 11 in varying load modes, observed in the embodiment. In order to simplify the explanation, it is assumed that the load is applied onto the line connecting two load sensors 11. When the load W is applied at a position between the load sensors 11 and 11, a positive load, which is dispersed in correspondence to the load position, is detected. In the example shown in the figures, the load W is applied at a middle point of the distance 2L between the load sensors 11 and 11 (at a point distanced from either load sensor 11 by L), and accordingly, the two load sensors 11 and 11 each detect ½ the load (W/2). By adding together the detection outputs from the two load sensors 11 and 11, the actual load W is ascertained.

Figure 6B:
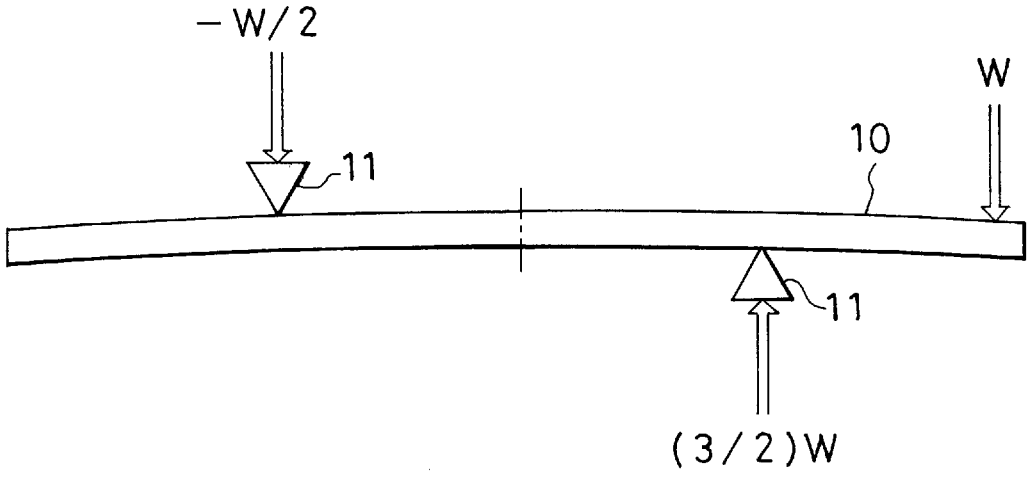

If, on the other hand, the load W is applied at a position outside the range between the load sensors 11 and 11, as shown in FIG. 6B, a load larger than the load W is applied to one of the load sensors 11. In the example presented in the figure, the load W is applied at the position further toward the outside relative to one of the load sensors 11, distanced from the load sensor by L and, accordingly, the load sensor 11 detects a positive load (3//2) W, whereas the other load sensor 11 at a greater distance from the load detects a negative load (−W/2). By adding these loads together, the actual load W is ascertained.

When four load sensors 11 are provided as in the embodiment, all the load sensors 11 detect positive loads if the load is applied at a position within the range enclosed by the load sensors, whereas only some of the load sensors 11 detect positive loads and the remaining load sensors 11 detect negative loads if the load is applied at a position outside the range. In either case, by adding together the loads detected by the individual load sensors, the correct load W is detected.

By adopting a structure which allows the load sensors 11 to detect positive and negative loads as described above, an accurate load detection is enabled even when the center of gravity of the load is placed at a position on the base 10 outside the range enclosed by the lines connecting the supporting portions, i.e., the mounting points at which the load sensors 11 are mounted, causing torsion in the base 10.

In addition, the load sensors 11, each achieved by pasting onto a plate member 14 distortion gauges 15~18 that register different resistance values depending upon the extent of flexure of the plate member 14, are not as expensive as standard load cells. The structure achieved by supporting the base 10 with the bracket 9, connecting one end of each load sensor 11 with the bracket 9, connecting the other end of each load sensor with the base 10 and providing elastic members such as the disk springs 27~29 at the connecting portions of the load sensors 11 toward the base 10 (or toward the bracket 9) so as to allow a displacement along both the upward direction and the downward direction enables a uniform load detection operation to be performed by the individual load sensors 11 to realize a highly accurate load detection even when the bracket 9 or the base 10 is twisted or the like.

While it is desirable to support the base 10 with the bracket 9 at four supporting points, the base 10 can be supported by the bracket 9 in a stable manner as long as the base 10 is supported at, at least, three points with the lines connecting the points forming a polygon. In addition, while it is desirable to provide a load sensor 11 at each of the four supporting points, an approximate load detection achieved by providing load sensors at two positions may suffice if the footing that the operator may assume on the work platform 7 is limited to a specific range.

Figure 4C:
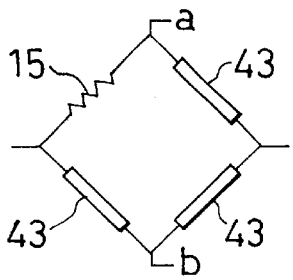
Figure 4D:
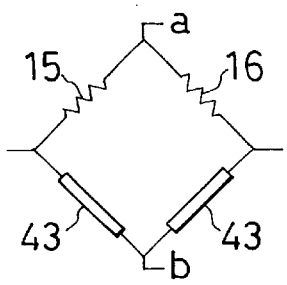

The load sensors may each adopt a structure achieved by pasting a distortion gauge 15 only onto the front surface or the rear surface of the plate member 14 and by building the distortion gauge 15 into one of the arms of the wheatstone bridge with fixed resistors 43 mounted at the other arms as shown in FIG. 4C to detect the voltage between A and B. However, by adopting a structure achieved by providing a pair of distortion gauges 15 and 16 at the front and rear surfaces of the plate member 14 and by building them into two arms of the wheatstone bridge with fixed resistors 43 mounted at the other arms as shown in FIG. 4D to detect the voltage between A and B as a load, a detection output that is twice the detection output from the load sensor shown in FIG. 4C is obtained as the sum of the detection outputs from the distortion gauges 15 and 16.

Moreover, by adopting the wheatstone bridge structure shown in FIG. 4B which is achieved by pasting two pairs of distortion gauges 15~18 at the front and rear surfaces of the plate member 14 as in the embodiment, the detection outputs from the distortion gauges 15 and 16 are added together and then the detection outputs from the distortion gauges 17 and 18 are added to the sum. As a result, an overall detection output which is four times that of the load sensor adopting the structure shown in FIG. 4C and twice of the detection output of the load sensor adopting the structure shown in FIG. 4D is achieved for even higher detection accuracy.

Figure 7:
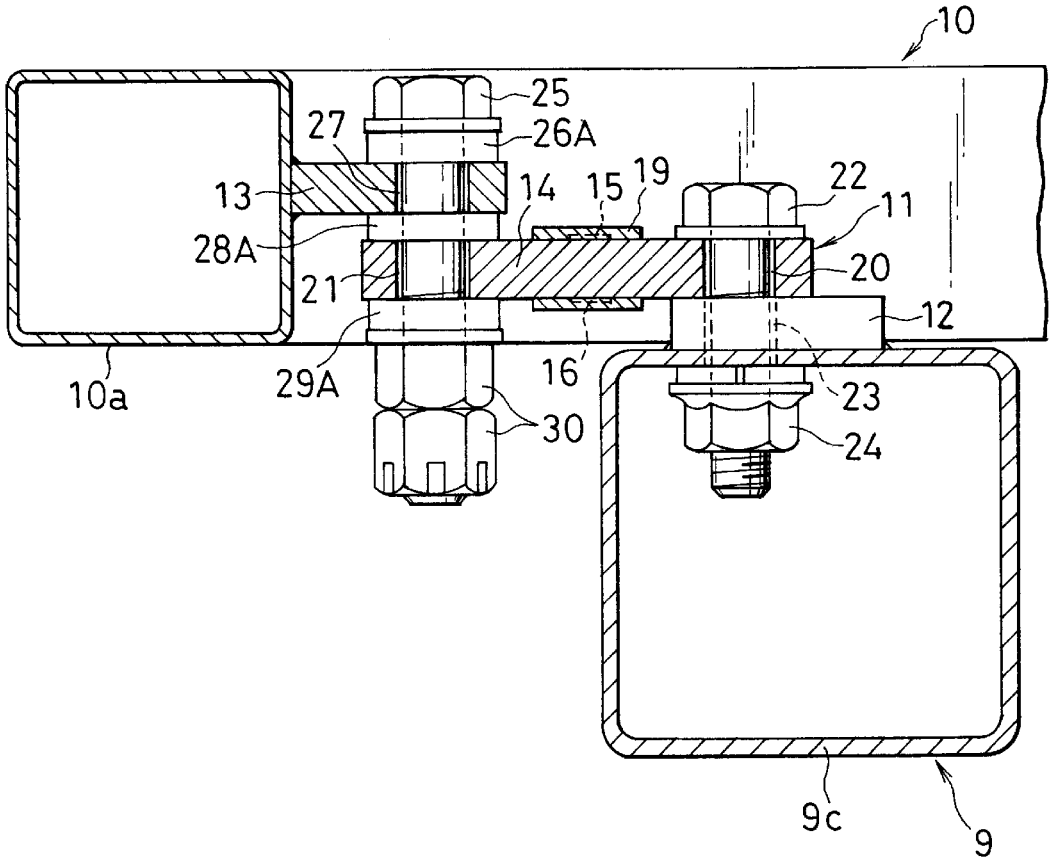
FIG. 7 is a sectional view of another example of the load sensor mounting structure that may be adopted in the present invention.

While the disk springs 27~29 are used as the elastic members provided at the area where each load sensor 11 is connected with the bracket 10 in the embodiment described above, hard rubber members 27A~29A may instead be used as elastic members, as shown in FIG. 7.

Figure 8:
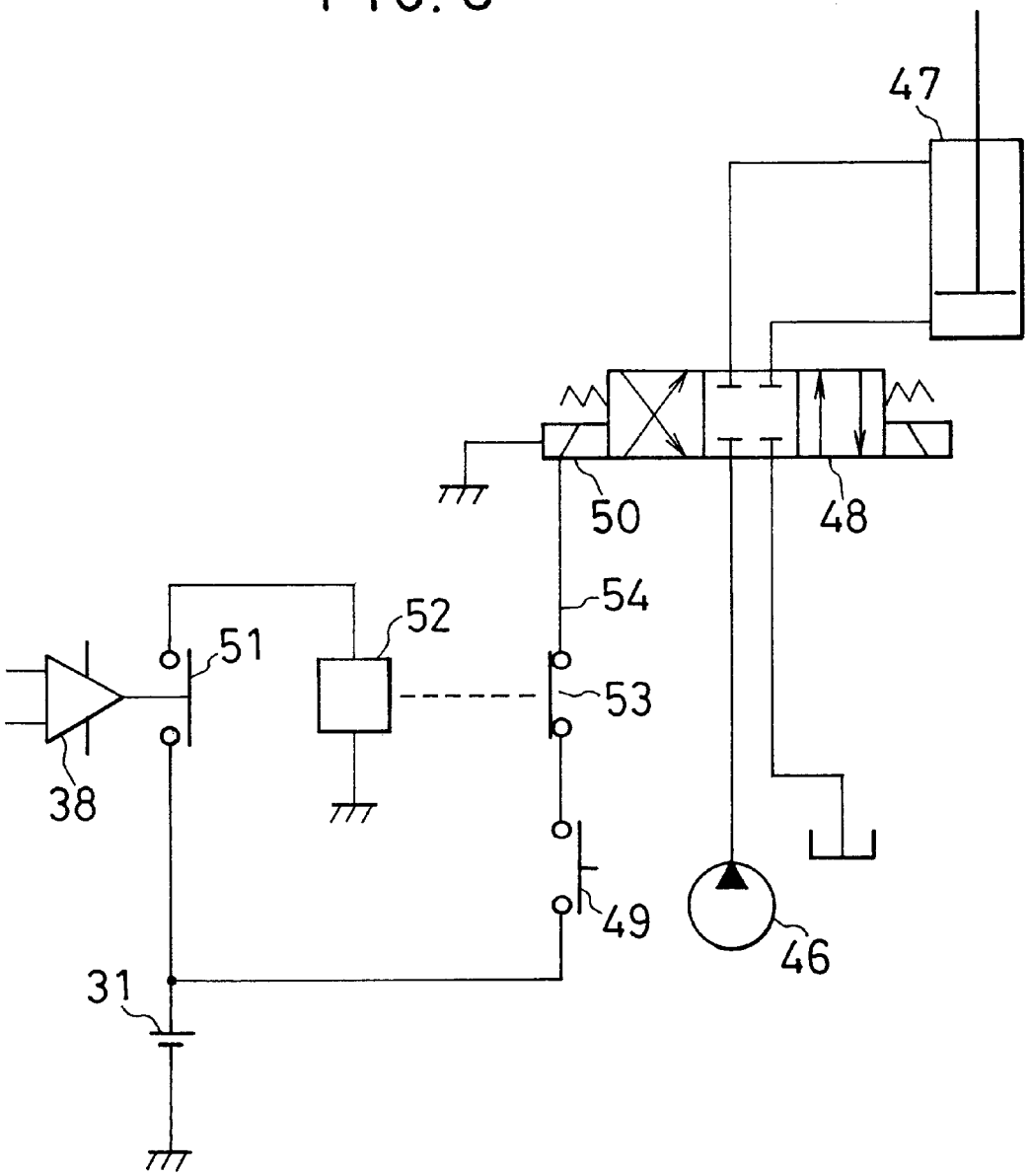
FIG. 8 presents an example of a circuit through which the movement of the work vehicle that would increase the work radius is disallowed when the work vehicle is in a state of overload according to the present invention.

FIG. 8 is a circuit diagram of an example of a means for control that disallows an operation of the work vehicle that would increase the work radius in response to an output from the comparator 38. In FIG. 8, reference numeral 46 indicates a hydraulic source mounted on the revolving superstructure 3, reference number 47 indicates a hydraulic cylinder for extending and contracting the telescopic boom 5, reference numeral 48 indicates the control valve that controls the hydraulic cylinder 47 and reference numeral 49 indicates an operating switch that switches the control valve 48 to a position for expanding the hydraulic cylinder by supplying power to a solenoid 50 on the hydraulic cylinder expansion side. Reference numeral 51 indicates a switch that is closed if the comparator 38 detects an overload state, reference numeral 52 indicates a relay that is excited by power supplied from the source 31 when the switch 51 is closed and reference numeral 53 indicates a normally-closed contact point of the relay 52, which is inserted in a circuit 54 of the operating switch 49.

In this circuit, as the output from the comparator 38 indicates an ON state, the relay contact point 53 opens, disallowing the power supply to the solenoid 50 of the control valve 48. As a result, the movement of the telescopic boom 5, which would increase its length, becomes disallowed for safety.

It is to be noted that the amplifier circuit 35, which calculates the sum of the load detection signals, and the comparator 38 may be realized through a means for digital operation. In addition, the means for control that disallows an operation that would increase the work radius in the embodiment may instead disallow a movement along the direction in which the telescopic boom 5 becomes lowered.

INDUSTRIAL APPLICABILITY

The present invention provides an overload detection device that is not as expensive as overload detection devices employing standard load cells, by pasting distortion gauges that register different resistance values onto a plate member, as the extent of flexure of the plate member changes to constitute each load sensor. In addition, since each load sensor is connected with the bracket or the base via elastic members which allow a displacement along both the upward direction and the downward direction, a uniform load detection operation is achieved by the individual load sensors to detect the load with a high degree of accuracy even when the bracket or the base is twisted.

What is claimed is:

1. An overload detection device for a high-lift work vehicle having a work platform mounted at a front end of a telescopic boom via a bracket, characterized in that:

a base of said work platform is supported with said bracket, at, at least, three supporting portions, load sensors each constituted of a plate member and distortion gauges pasted onto said plate member to detect an extent of flexure thereof are provided at, at least, two of said supporting portions; and each of said load sensors is mounted with two ends of said plate member connected with said bracket and said base by using bolts and an elastic member which allows a displacement of said load sensor relative to said bracket or said base along an upward direction and a downward direction is provided at the area where said load sensor is connected with either said bracket or said base.

2. An overload detection device for a high-lift work vehicle according to claim 1, characterized in that:

said load sensors are each constituted by pasting distortion gauges capable of detecting positive and negative loads onto a front surface and a rear surface of said plate member.

3. An overload detection device for a high-lift work vehicle according to claim 2, characterized in that:

said load sensors are each constituted by pasting distortion gauges two each onto the front surface and the rear surface of said plate member so that distortion gauges on one surface face opposite distortion gauges on the other surface; and said distortion gauges are built into a wheatstone bridge to achieve a circuit structure through which a load detection signal is obtained as a sum of a distortion detection quantity from one pair of distortion gauges facing opposite each other at the front and the rear surface of said plate member and a distortion detection quantity from the other pair of distortion gauges facing opposite each other at the front surface and the rear surface of said plate member.

4. An overload detection device for a high-lift work vehicle according to claim 3, characterized in that:

output lines of individual wheatstone bridges are connected in parallel to one another and are input to an amplifier circuit to obtain an average of distortion detection quantities from said wheatstone bridges by averaging the distortion detection quantities.

5. An overload detection device for a high-lift work vehicle according to claim 1, characterized in that:

said base is supported by said bracket at four supporting portions equivalent to corners of a square or a rectangle having two sides thereof extending along a front/rear direction and said load sensor are provided at, at least, two of said supporting portions.

6. An overload detection device for a high-lift work vehicle according to claim 1, further provided with:

a means for comparison that compares a load detection value obtained based upon detection signals from said load sensors with a predetermined overload value; and a means for warning generation that issues a warning if an overload state is detected by said means for comparison.

7. An overload detection device for a high-lift work vehicle according to claim 1, further provided with:

a means for comparison that compares a load detection value obtained based upon detection signals from said load sensors with a predetermined overload value; and a means for control that disallows an operation that would increase the work radius if an overload state is detected by means said means for comparison.

8. An overload detection device for a high-lift work vehicle according to claim 1, further provided with:

a means for comparison that compares a load detection value obtained based upon detection signals from said load sensors with a predetermined overload value;

a means for warning generation that issues a warning if an overload state is detected by said means for comparison; and a means for control that disallows an operation that would increase the work radius if an overload state is detected by said means for comparison.

9. An overload detection device for a high-lift work vehicle according to claim 1, characterized in that:

said base is supported by said bracket at four supporting portions equivalent to corners of a square or a rectangle having two sides thereof extending along a front/rear direction and said load sensor are provided at, at least, two of said supporting portions; and further provided with a means for comparison that compares a load detection value obtained based upon detection signals from said load sensors with a predetermined overload value; and a means for warning generation that issues a warning if an overload state is detected by said means for comparison.

10. An overload detection device for a high-lift work vehicle according to claim 1, characterized in that:

said base is supported by said bracket at four supporting portions equivalent to corners of a square or a rectangle having two sides thereof extending along a front/rear direction and said load sensor are provided at, at least, two of said supporting portions; and further provided with a means for comparison that compares a load detection value obtained based upon detection signals from said load sensors with a predetermined overload value; and a means for control that disallows an operation that would increase the work radius if an overload state is detected by said means for comparison.

11. An overload detection device for a high-lift work vehicle according to claim 1, characterized in that:

said base is supported by said bracket at four supporting portions equivalent to corners of a square or a rectangle having two sides thereof extending along a front/rear direction and said load sensor are provided at, at least, two of said supporting portions; and further provided with:

a means for comparison that compares a load detection value obtained based upon detection signals from said load sensors with a predetermined overload value;

a means for warning generation that issues a warning if an overload state is detected by said means for comparison; and a means for control that disallows an operation that would increase the work radius if an overload state is detected by said means for comparison.

* * * * *